US006064369A

United States Patent [19]

Okabe et al.

[11] Patent Number: 6,064,369

[45] Date of Patent: May 16, 2000

[54] JOYSTICK CONTROLLER

[75] Inventors: Kenji Okabe; Hirokatsu Omori, both of Tokyo, Japan

[73] Assignee: Sanwa Denshi Co., Ltd., Tokyo, Japan

[21] Appl. No.: 09/050,472

[22] Filed: Mar. 30, 1998

[30] Foreign Application Priority Data

Apr. 4, 1997 [JP] Japan ..... 9-087079

[51] Int. Cl.[7] ..... G09G 5/08

[52] U.S. Cl. ..... 345/161; 200/6 A; 74/471 XY

[58] Field of Search ..... 345/161, 157; 200/6 A, 5 R, 6 R, 176, 177; 74/471 XY; 338/118–128

[56] References Cited

U.S. PATENT DOCUMENTS

| | | | |
|---|---|---|---|
| 4,533,899 | 8/1985 | Isaksson | 338/128 |
| 4,825,019 | 4/1989 | Fisher | 200/6 A |
| 4,857,881 | 8/1989 | Hayes | 338/128 |
| 5,279,376 | 1/1994 | Yang et al. | 180/6.48 |
| 5,286,024 | 2/1994 | Winblad | 273/148 B |
| 5,576,704 | 11/1996 | Baker et al. | 341/20 |
| 5,854,622 | 12/1998 | Brannon | 345/161 |

*Primary Examiner*—Richard A. Hjerpe
*Assistant Examiner*—Masih Siavoshan
*Attorney, Agent, or Firm*—Notaro & Michalos P.C.

[57] ABSTRACT

A joystick controller sufficiently strong and durable not to easily be broken even when handled somehow roughly, reasonably compact and which can be manufactured with less costs, is provided by composing it of a housing provided thereon with a plurality of potentiometers, a hollow shell bearing born inside the housing rotatably in one direction and which has a first pair of auxiliary arms attached on either side thereof and extending outwardly; an intermediate bearing born inside the shell bearing rotatably in a direction orthogonal to the shell bearing; a joystick attached rockably on the intermediate bearing and extending upwardly of the housing through a first pair of guide slots formed in the shell bearing; a core bearing pivoted inside the intermediate bearing rotatably in a same direction as the intermediate bearing; and a second pair of auxiliary arms attached on the core bearing, extending in a direction orthogonal to the first pair of auxiliary arms through an aperture formed in the intermediate bearing and a second guide slot formed in a direction orthogonal to the first pair of guide slots in the shell bearing and rockably born inside the housing; and coupling the first and second pairs of auxiliary arms to rotating shafts of the potentiometers respectively.

4 Claims, 6 Drawing Sheets

JOYSTICK CONTROLLER

BACKGROUND OF THE INVENTION

1. Field of the Invention

The present invention relates to a joystick controller, and more particularly, to a joystick controller most suitably usable with a video game machine to control a video game.

2. Description of the Prior Art

In addition to the joystick controller for use with a video same machine, various types of joystick controllers have been proposed for remote control of a model plane, helicopter or the like, a sound balancing device in a 4-channel stereo player, or other machines.

Such joystick controllers are known from the disclosures in the Japanese Publication of Unexamined Utility Model Application No. 29557/80, Publication of Unexamined Patent Application No. 140202/80 and Publication of Unexamined Utility Model Application No. 33206/84, for instance. One of these publications discloses a joystick controller comprising a frame body, a joystick supported in the frame body rockably in all directions (360°), arcuate members, crossing each other, pivoted rockably to the frame body and each having an elongated hole formed therein, and a potentiometer installed to each of support shafts of the arcuate members. Therefore, as the joystick is rocked, the arcuate members are rocked correspondingly.

Further, the Japanese Publication of Unexamined Patent Application No. 100759/93 discloses a joystick position sensing system, comprising a housing having first and second potentiometers mounted thereon, a pivot ball movably mounted on the housing and defining a prime axis, the pivot ball being formed with first and second grooves, the grooves defining portions of respective first and second great circles each intersecting the prime axis, the plane of the first great circle being substantially orthogonal to the plane of the second great circle, a joystick attached to the pivot ball and extending outwardly therefrom, a first follower arm slidably engaged with the first groove and operatively engaged with the first potentiometer for generating a first signal representative of the orientation of the first groove relative to the housing, a second follower arm slidably engaged with the second groove and operatively coupled with the second potentiometer for generating a second signal representative of the position of the second groove relative to the housing, and means electrically coupled to the first and second potentiometers for generating a third signal representative of the position of the joystick relative to the housing.

However, since the above-mentioned prior-art joystick controllers for the radio control of a model plane, helicopter or the like and remote control of the sound balancing apparatus in the 4-channel stereo player are not sufficiently robust to resist a possible rough handling to which no major consideration is given when they are designed, they are not advantageous in strength and durability. The conventional joystick controllers for control of a video game are large and complicated, which lead to increased manufacturing costs.

SUMMARY OF THE INVENTION

Accordingly, the present invention has an object to overcome the above-mentioned drawbacks of the prior art by providing a joystick controller sufficiently robust and durable not to easily be broken even if handled somehow roughly, designed reasonably compact and which can be manufactured with less costs.

The joystick controller according to the present invention is most suitably usable with a video game machine to control a video game. As understandable from the foregoing, however, the joystick controller of the present invention is not limited in application for control of a video game machine.

The above object can be accomplished by providing a joystick controller, comprising, according to the present invention, a housing having a plurality of potentiometers provided thereon, a hollow shell bearing born inside the housing rotatably in one direction, a first pair of auxiliary arms provided on either side of the shell bearing and extending outwardly therefrom, an intermediate bearing born inside the shell bearing rotatably in a direction orthogonal to the shell bearing, a joystick provided rockably on the intermediate bearing and extending upwardly of the housing through one of a first pair of guide slots formed in the shell bearing, a core bearing pivoted inside the intermediate bearing rotatably in a same direction as the intermediate bearing, and a pair second pair of auxiliary arms provided on the core bearing, rockably born inside the housing, and extending in a direction orthogonal to the first pair of auxiliary arms through an aperture formed in the intermediate bearing and a second pair of guide slots formed in a direction orthogonal to the first pair of guide slots in the shell bearing, the first and second auxiliary arms being coupled to rotating shafts of the potentiometers, respectively.

Also, the joystick may have provided thereon a self-resetting means to urge the joystick once tilted to an upright or home position.

Further, the shell bearing may be formed from two parts.

BRIEF DESCRIPTION OF THE DRAWINGS

These objects and other objects, features, aspects and advantages of the present invention will become more apparent from the following detailed description of the present invention when taken in conjunction with the accompanying drawings, of which.

DETAILED DESCRIPTION OF THE PREFERRED EMBODIMENTS

Figure 1:
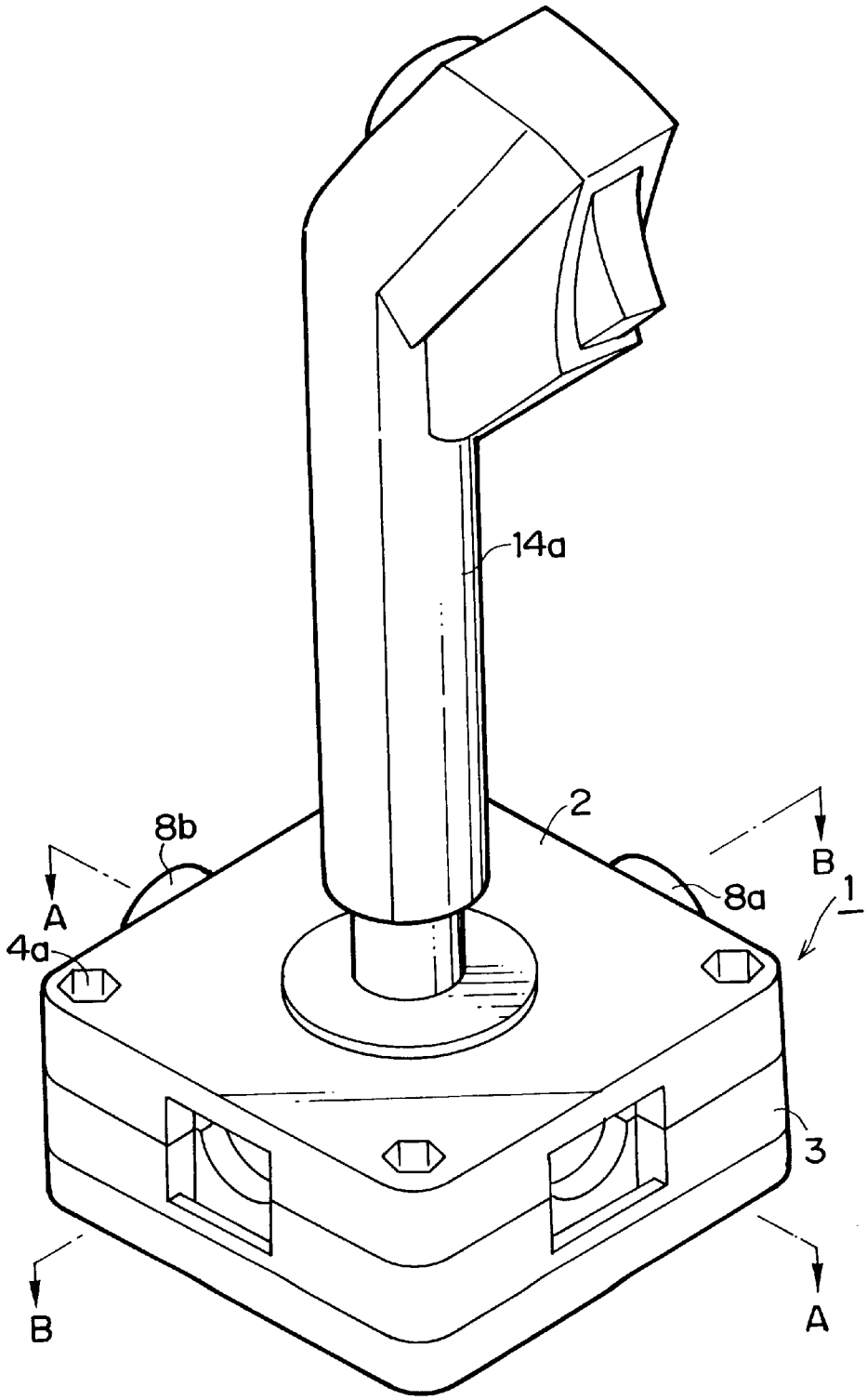
FIG. 1 is a perspective view of a joystick controller according to the present invention.
Figure 2:
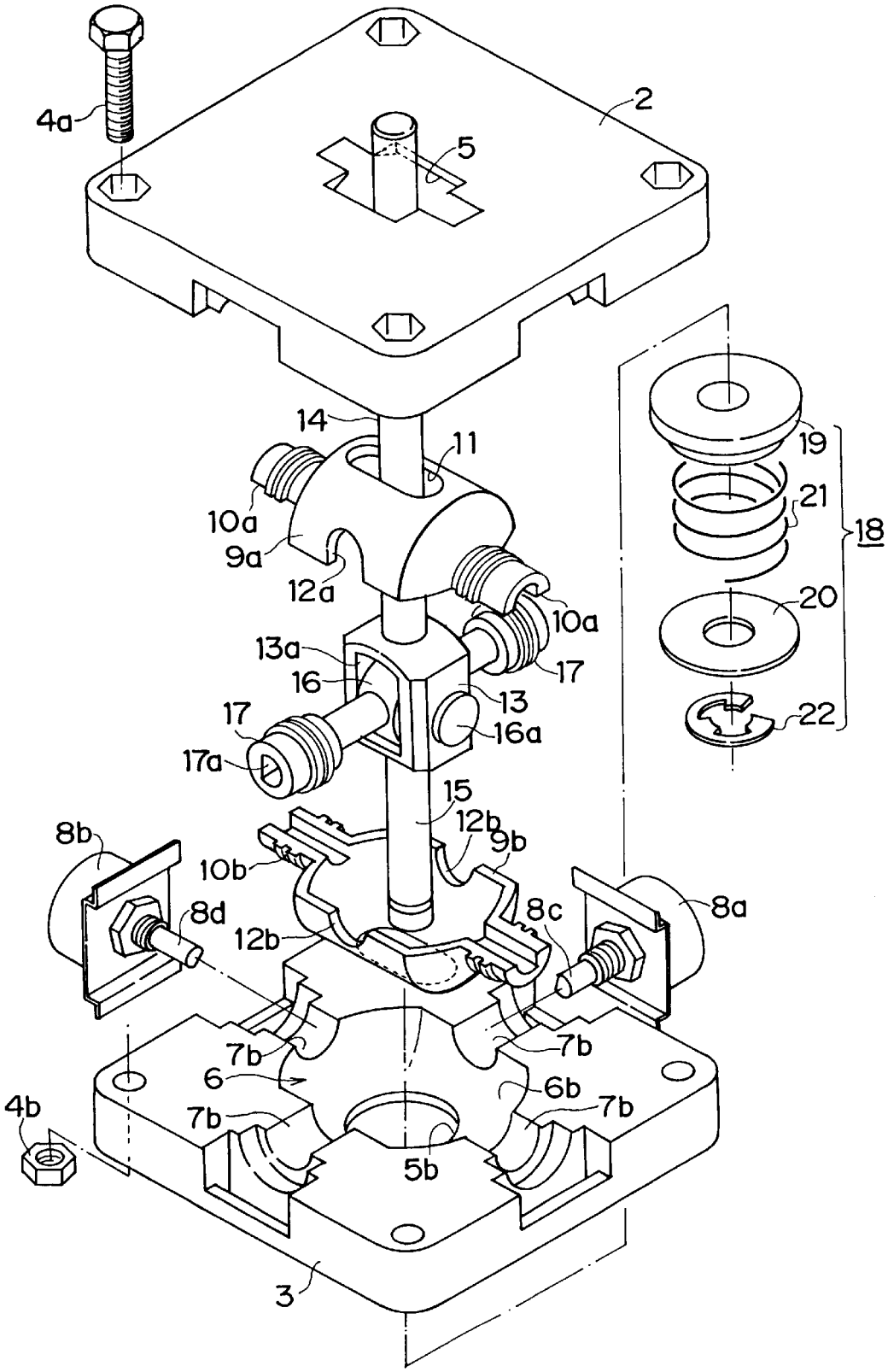
FIG. 2 is a partially fragmentary, exploded perspective view of the joystick controller shown in FIG. 1.

As shown in Figures, the joystick controller according to the present invention comprises a housing generally indicated with a reference numeral 1 consisting of two blocks, upper and lower, 2 and 3. The housing 1 is formed by aligning the upper and lower blocks 2 and 3 vertically with each other and securing them to each other with a bolt 4*a* and a nut 4*b*. These blocks 2 and 3 have openings 5*a* and 5*b* formed generally in the center thereof, respectively, and through which a joystick which will be described later is vertically penetrated. The opening 5*a* in the upper block 2 has the form of a cross while the opening 5*b* in the lower block 3 is circular. However, the shapes of these openings 5*a* and 5*b* are not limited to these cross and circle but may be of any suitable ones. The blocks 2 and 3 have concavities 6*a* and 6*b* formed therein about the openings 5*a* and 5*b*, respectively, thereof to have the cross-sectional shape of a semi-circle. When the blocks 2 and 3 are secured to each other, the concavities 6*a* and 6*b* will join each other to define a socket 6. Further, the blocks 2 and 3 have formed therein two pairs of recesses 7*a* and 7*b*, respectively, each having a semi-circular sectional shape. In each of the pairs, the recesses extend in a line, and one pair of the recesses is orthogonal to the other pair. When the two blocks 2 and 3 are secured to each other, each pair of the recesses 7*a* in the block 2 join a corresponding pair of the recesses 7*b* in the block 3, to define four bearing holes 7. There are provided potentiometers 8*a* and 8*b* in open end portions of two, adjacent to each other, of the four bearing holes 7. The embodiment of the present invention uses two potentiometers 8*a* and 8*b*. The potentiometers 8*a* and 8*b* have rotating shafts 8*c* and 8*d*, respectively, each having a portion of which the cross-sectional shape is non-circular. However, this quantity of the potentiometers used in the present invention is not limited to two, but it may be increased to three or four, for example, as necessary.

A shell bearing 9 consisting of two casings 9*a* and 9*b* and shaped like a hollow drum is born inside the socket 6 rotatably in one direction. A first pair of auxiliary arms 10 in line with each other attached at either end of the shell bearing 9, and extends outwardly in the direction of their common axis from either end of the shell bearing 9. Each of the first pair of auxiliary arms 10 is comprised of a pair of projections 10*a* and 10*b* each having a semi-circular sectional shape and which are secured to each other. The auxiliary arms 10 in the first pair are born in the bearing holes 7, respectively. Further, the shell bearing 9 has formed in the casings 9*a* and 9*b*, respectively, thereof a first pair of guide slots 11 extending axially of the first pair of auxiliary arms 10, and it has also formed in the casings 9*a* and 9*b*, respectively, thereof a second pair of guide slots 12 vertically elongated and of which the axis extends orthogonally to the first pair of guide slots 11. Each of the second pair of guide slots 12 is composed of semi-circular cuts 12*a* and 12*b* made also in the casings 9*a* and 9*b*, respectively, of the shell bearing 9. The auxiliary arms 10 in the first pair have formed therein fitting through-holes 10*c*, respectively, of which the cross section has a non-circular shape. The non-circular portion of the rotating shaft 8*d* of the potentiometer 8*b* is fitted in the non-circular fitting through-hole 10*c* of one of the first pair of auxiliary arms 10 rotatably with the latter.

Further, the shell bearing 9 has rotatably born therein a hollow intermediate bearing 13 having attached on the top thereof an upwardly projecting joystick 14. The joystick 14 extends through the upper one of the first pair of guide slots 11 formed in the shell bearing 9, and projects upwardly out of the upper opening 5*a* formed in the housing 1. As shown in FIG. 1, a cover 14*a* is provided on the joystick 14. The intermediate bearing 13 has also attached on the bottom thereof a control rod 15 extending downward in line with the joystick 14. The control rod 15 is passed through the lower one of the first pair of guide slots 11 formed in the shell bearing 9, and projects downward out of the lower opening Sb of the housing 1.

The intermediate bearing 13 has rotatably born therein a core bearing 16. The core bearing 16 is secured to the intermediate bearing 13 with a support pin 16*a*. The core bearing 16 has attached on either lateral side thereof a second pair of second auxiliary arms 17 extending through an aperture 13*a* formed in the intermediate bearing 13 in opposite directions, respectively, orthogonal to the first auxiliary arms 10. The second pair of auxiliary arms 17 extend through the second pair of guide slots 12, respectively, in the shell bearing 9, and are born in the bearing holes 7, respectively. A potentiometer 8*a* is provided on one of the second pair of auxiliary arms 17. Each of the second pair of auxiliary arms 17 has formed therein a bore 17*a* having a non-circular cross-section. The potentiometer 8*a* has a rotating shaft 8*c* with a portion of which the cross-section is non-circular. The non-circular shaft portion of the potentiometer 8*a* is fitted in the non-circular bore 17*a* in the auxiliary arms 17 in the second pair rotatably with the latter.

There is provided on a portion of the control rod 15 that projects out of the housing 1 a self-resetting means 18 to always return the joystick 14 to the home position from a tilted position to which the joystick 14 is urged. The self-resetting means 18 consists of a pair of spring receptacles or seats 19 and 20, and a coil spring 21 provided on the control rod 15 and between the spring seats 19 and 20. One 19 of the pair of spring seats abuts the housing 1 while the other 20 is retained by an E-ring 22 fixed to the lower end of the control rod 15.

Figure 3:
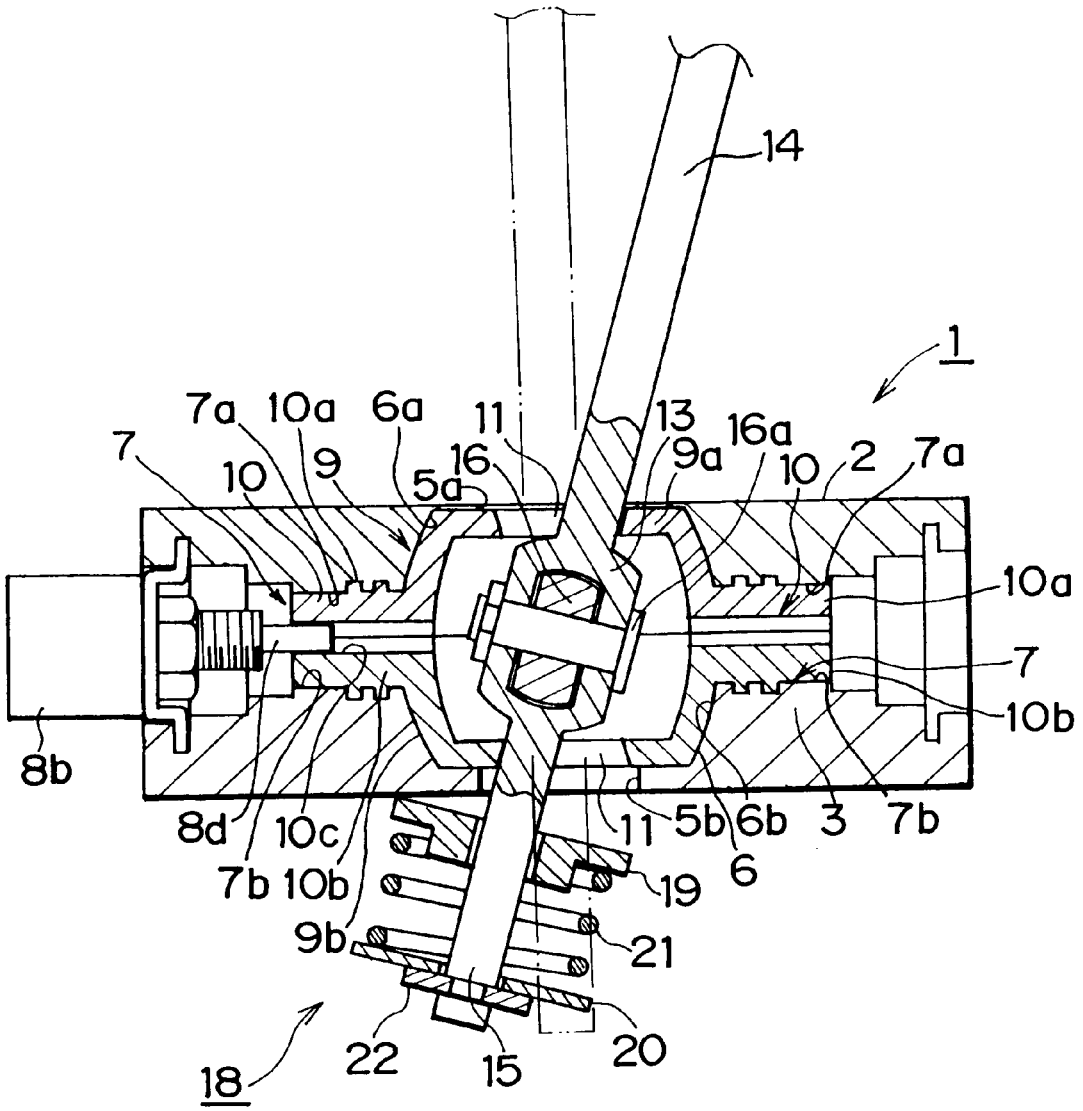
FIG. 3 is a sectional view taken along the line A—A in FIG. 1, showing the joystick tilted toward one end of the first guide slot.
Figure 4:
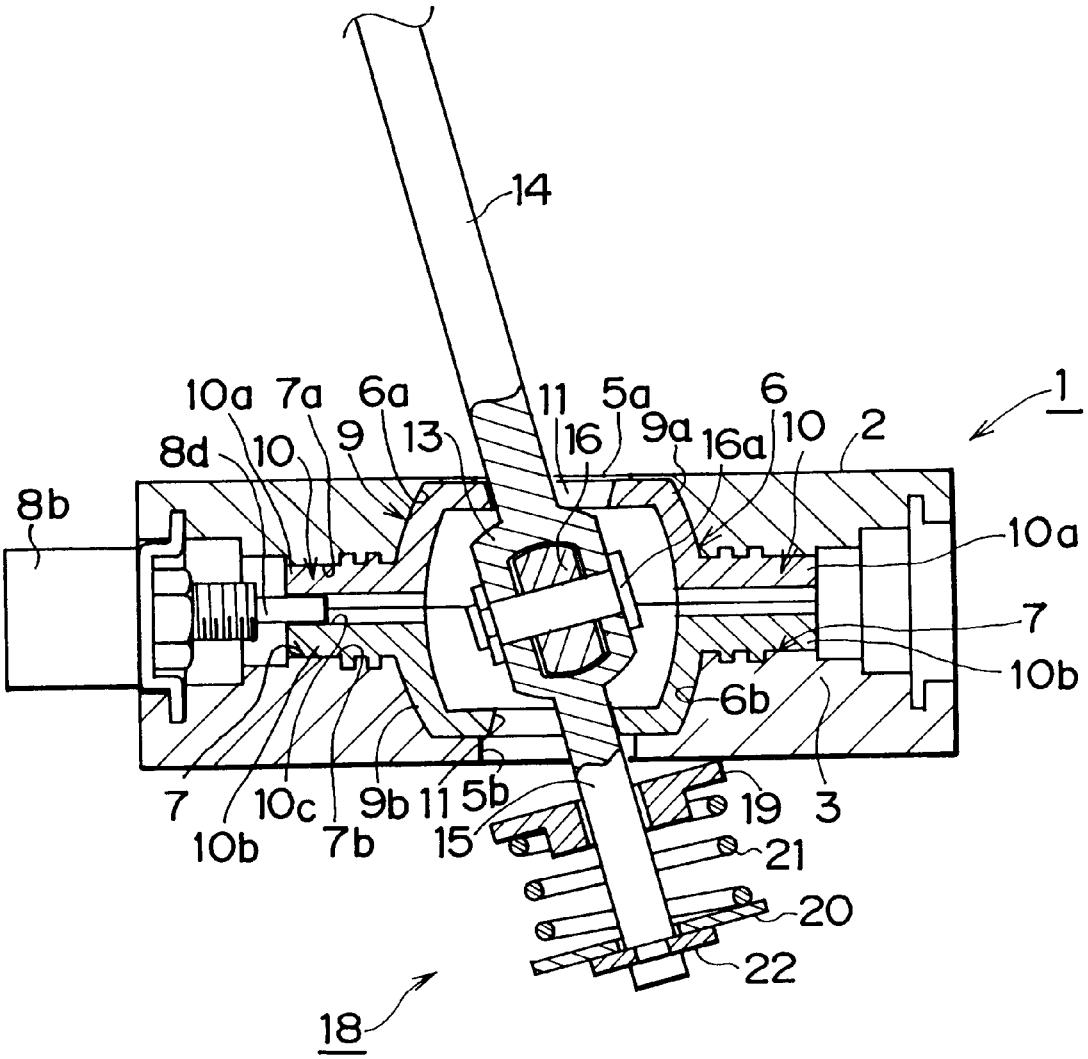
FIG. 4 is also a sectional view of the joystick tilted toward the other end of the first guide slot from the position shown in FIG. 3.

The joystick controller thus formed functions as will be explained herebelow with reference to FIGS. 3 to 6:

As the joystick 14 standing in an upright or home position indicated with an imaginary line in FIG. 3 is pressed in a longitudinal direction of the first pair of guide slots 11 formed in the shell bearing 9 as shown with a solid line in FIGS. 3 and 4, it is tilted along the first pair of guide slots 11 against the resilience of the spring 21 of the self-resetting means 18, and thus the core bearing 16 is rotated correspondingly. The second pair of auxiliary arms 17 extending from the core bearing 16 are so rotated together with the latter. Therefore, the rotating shaft 8*c* of the potentiometer 8*a* coupled to one of the second pair of auxiliary arms 17 is rotated correspondingly.

Figure 5:
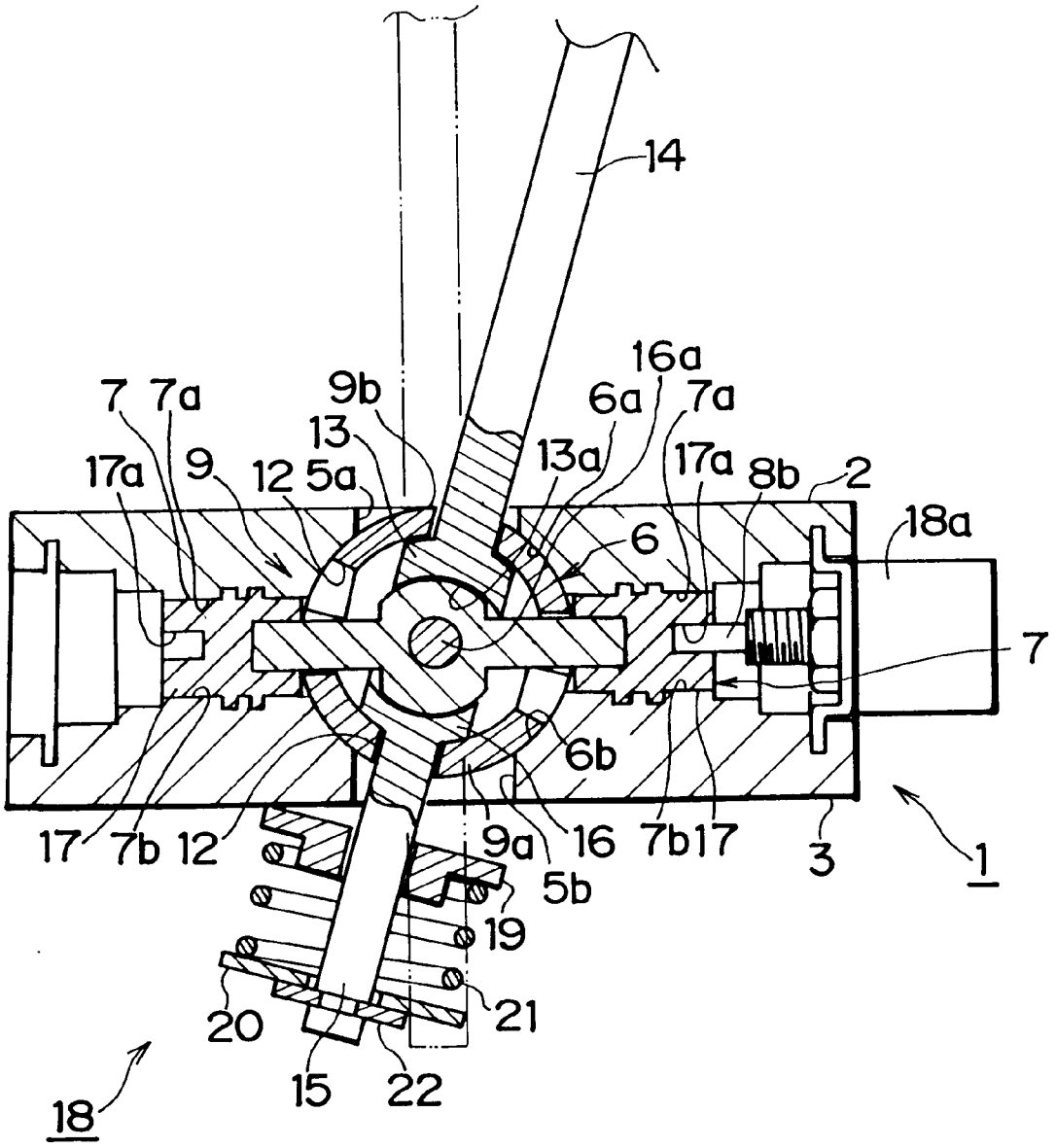
FIG. 5 is a sectional view taken along the line B—B in FIG. 1, showing the joystick tilted in a direction orthogonal to the first guide slot.
Figure 6:
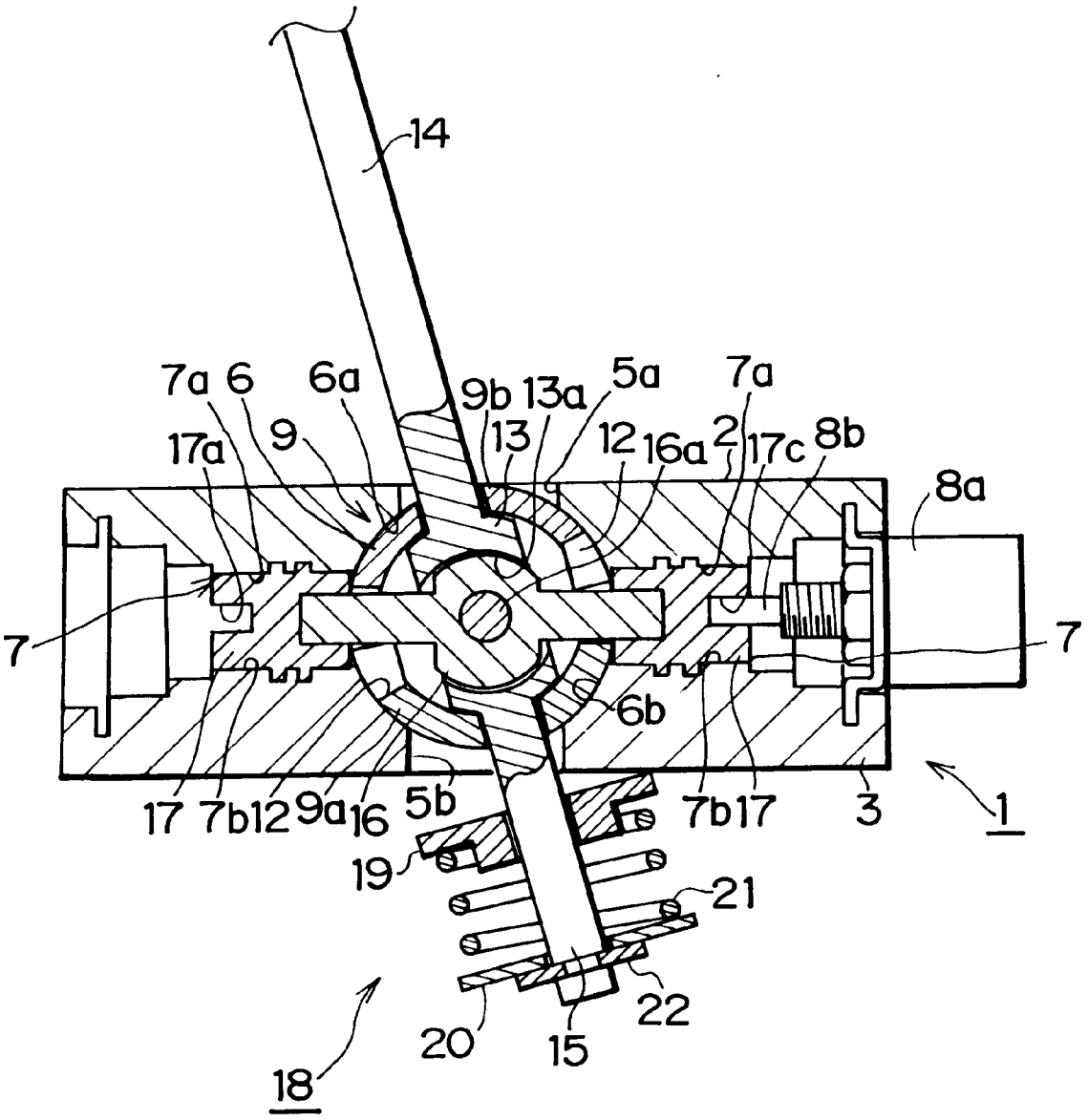
FIG. 6 is also a sectional view of the joystick tilted in a direction orthogonal to the first guide slot, opposite to the tilted direction of the joystick in FIG. 5.

On the other hand, when the joystick 14 in an upright position indicated with an imaginary line in FIG. 5 is pressed axially of the second pair of guide slots 12 orthogonal to the first pair of guide slots 11 formed in the shell bearing 8 as indicated with a solid line in FIGS. 5 and 6, it is rocked along with the shell bearing 9, thus the first pair of auxiliary arms 10 are rotated. The rotating shaft 8*d* of the potentiometer 8*b* coupled to one of the first pair of auxiliary arms 10 is thus rotated correspondingly. At this time, since the auxiliary arms 17 in the second pair are moved along the second pair of guide slots 12 in the shell bearing 9 while being rocked, so they will not block the shell bearing 9 from rotating or rotate with the latter, allowing the joystick 14 to tilt or rock. Also, as the intermediate bearing 13 is rotated and slides on the periphery of the core bearing 16, the second pair of auxiliary arms 17 projecting from the core bearing 16 will not be tilted along with the joystick 14 as will be seen from FIGS. 5 and 6 when the latter is titled.

In the foregoing, tilting of the joystick 14 in the X- and Y-directions orthogonal to each other has been described. However, the tilting direction of the joystick 14 is not limited only to this X- and Y-directions. Since the shell bearing 9, intermediate bearing 13 and core bearing 16 are rotated as interlocked with each other even when the joystick 14 is tilted in any direction, the joystick 14 can be tilted in any direction within a range of 360°, and a tilted angle of the joystick 14 in the tilting direction is conveyed to the rotating shaft 8*c* or 8*d* of the potentiometer 8*a* or 8*b* respectively, via the first or second pair of auxiliary arms 10 or 17 of which the rotated amount varies depending upon the tilting direction of the joystick 14. The rotating shaft 8*c* or 8*d* of the potentiometer 8*a* or 8*b* are thus rotated correspondingly by means of the first or second pair of auxiliary arms 10 or 17, respectively.

What is claimed is:

1. A joystick controller, comprising:

a housing having a plurality of potentiometers provided thereon a hollow shell bearing born inside the housing rotatably in one direction;

a first pair of auxiliary arms provided on either side of the shell bearing and extending outwardly therefrom;

an intermediate bearing born inside the shell bearing rotatably in a direction orthogonal to the shell bearing;

a joystick provided rockably on the intermediate bearing and extending upwardly of the housing through one of a first pair of guide slots formed in the shell bearing;

a core bearing pivoted inside the intermediate bearing rotatably in a same direction as the intermediate bearing; and a second pair of auxiliary arms provided on the core bearing, rockably born inside the housing, and extending in a direction orthogonal to the first pair of auxiliary arms through an aperture formed in the intermediate bearing and a second pair of guide slots formed in a direction orthogonal to the first pair of guide slots in the shell bearing;

the first and second auxiliary arms being coupled to rotating shafts of the potentiometers, respectively.

2. A joystick controller, comprising:

a housing having a plurality of potentiometers provided thereon a hollow shell bearing born inside the housing rotatably in one direction;

a first pair of auxiliary arms provided on either side of the shell bearing and extending outwardly therefrom;

an intermediate bearing born inside the shell bearing rotatably in a direction orthogonal to the shell bearing;

a joystick provided rockably on the intermediate bearing and extending upwardly of the housing through one of a first pair of guide slots formed in the shell bearing;

a core bearing pivoted inside the intermediate bearing rotatably in a same direction as the intermediate bearing; and a second pair of auxiliary arms provided on the core bearing, rockably born inside the housing, and extending in a direction orthogonal to the first pair of auxiliary arms through an aperture formed in the intermediate bearing and a second pair of guide slots formed in a direction orthogonal to the first pair of guide slots in the shell bearing;

the first and second pairs of auxiliary arms being coupled to rotating shafts of the potentiometers, respectively;

the joystick having provided thereon a self-resetting means to always urge the joystick once tilted to an upright position.

3. A joystick controller, comprising a housing having a plurality of potentiometers provided thereon a hollow shell bearing born inside the housing rotatably in one direction;

a first pair of auxiliary arms provided on either side of the shell bearing and extending outwardly therefrom;

an intermediate bearing born inside the shell bearing rotatably in a direction orthogonal to the shell bearing;

a joystick provided rockably on the intermediate bearing and extending upwardly of the housing through one of a first pair of guide slots formed in the shell bearing;

a core bearing pivoted inside the intermediate bearing rotatably in a same direction as the intermediate bearing; and a second pair of auxiliary arms provided on the core bearing, rockably born inside the housing, and extending in a direction orthogonal to the first pair of auxiliary arms through an aperture formed in the intermediate bearing and a second pair of guide slots formed in a direction orthogonal to the first pair of guide slots in the shell bearing;

the first and second pairs of auxiliary arms being coupled to rotating shafts of the potentiometers, respectively, the shell bearing consisting of two parts and having born therein the intermediate bearing rotatably in one direction.

4. A joystick controller, comprising:

a housing having a plurality of potentiometers provided thereon a hollow shell bearing born inside the housing rotatably in one direction;

a first pair of auxiliary arms provided on either side of the shell bearing and extending outwardly therefrom;

an intermediate bearing born inside the shell bearing rotatably in a direction orthogonal to the shell bearing;

a joystick provided rockably on the intermediate bearing and extending upwardly of the housing through one of a first pair of guide slots formed in the shell bearing;

a core bearing pivoted inside the intermediate bearing rotatably in a same direction as the intermediate bearing; and a second pair of auxiliary arms provided on the core bearing, rockably born inside the housing, and extending in a direction orthogonal to the first pair of auxiliary arms through an aperture formed in the intermediate bearing and a second pair of guide slots formed in a direction orthogonal to the first pair of guide slots in the shell bearing;

the joystick having provided thereon a self-resetting means to always urge the joystick once tilted to an upright position, the first and second pairs of auxiliary arms being coupled to rotating shafts of the potentiometers, respectively;

the shell bearing consisting of two parts and having born therein the intermediate bearing rotatably in one direction.

* * * * *